US005129558A

United States Patent [19]

Feuerman

[11] Patent Number: 5,129,558

[45] Date of Patent: Jul. 14, 1992

[54] SEWING NEEDLE WITH EASY THREADING FILAMENT LOOP

[75] Inventor: Arnold I. Feuerman, West Bloomfield, Mich.

[73] Assignee: Feuerman Research & Development, West Bloomfield, Mich.

[21] Appl. No.: 512,006

[22] PCT Filed: Feb. 3, 1987

[86] PCT No.: PCT/US87/00244

§ 371 Date: Oct. 12, 1988

§ 102(e) Date: Oct. 12, 1988

[87] PCT Pub. No.: WO88/06197

PCT Pub. Date: Aug. 25, 1988

Related U.S. Application Data

[63] Continuation of Ser. No. 297,194, Oct. 12, 1988, abandoned.

[51] Int. Cl.[5] ..... D05B 85/00

[52] U.S. Cl. ..... 223/102; 606/224

[58] Field of Search ..... 223/99, 102; 606/222, 606/223, 224, 225, 226, 227

[56] References Cited

U.S. PATENT DOCUMENTS

| | | | |
|---|---|---|---|
| 424,518 | 4/1890 | Van Norman | 223/99 |
| 1,293,660 | 2/1919 | Armstrong | 223/102 |
| 1,960,117 | 5/1934 | Lydeard | 606/225 |
| 2,167,080 | 7/1939 | Mason | 223/99 |
| 2,715,486 | 8/1955 | Marcoff et al. | 223/102 |
| 2,826,850 | 3/1958 | Loudan | 43/17.5 |
| 4,090,649 | 5/1978 | Cichinski | 223/99 |
| 4,102,478 | 7/1978 | Samolov | 223/99 |
| 4,133,339 | 1/1979 | Naslund | 606/226 X |
| 4,667,860 | 5/1987 | Feuerman | 223/99 |
| 4,720,026 | 1/1988 | Feuerman | 223/99 |

FOREIGN PATENT DOCUMENTS

| | | | |
|---|---|---|---|
| 386973 | 12/1923 | Fed. Rep. of Germany . | |
| 2746737 | 4/1979 | Fed. Rep. of Germany | 223/99 |
| 505345 | 12/1954 | Italy | 223/99 |
| 8806197 | 8/1988 | World Int. Prop. O. | 223/102 |

*Primary Examiner*—Werner H. Schroeder
*Assistant Examiner*—Sara M. Current
*Attorney, Agent, or Firm*—Krass & Young

[57] ABSTRACT

A sewing needle has a main body 10 and a closed loop 18 of a resilient filament material rigidly secured to the rear end of the main body and lying a single common plane with the lengthwise axis of the main body. In unstressed condition, the filament has an open diamond configuration allowing a sewing thread to be easily passed through it. As the needle is pulled through the fabric, the loop collapses under the forces imposes on its sides by the fabric and thereafter expands to reassume its unstressed configuration. The rigid securement of the loop to the main body of the needle ensures that the loop remains in a single common plane with the needle axis as it collapses upon passage through the fabric and as it expands to its unstressed configuration following such passage.

1 Claim, 2 Drawing Sheets

SEWING NEEDLE WITH EASY THREADING FILAMENT LOOP

This is a continuation of co-pending application Ser. No. 297,194 filed on Oct. 12, 1988 now abandoned.

FIELD OF THE INVENTION

This invention relates to a sewing needle having a filament loop at its trailing end so that the needle may be easily threaded.

BACKGROUND OF THE INVENTION

Because of the well-known difficulty of threading conventional manual sewing needles having narrow eyes formed at their trailing ends, a form of needle has been proposed incorporating a closed loop of a thin filament secured to the rear end of the needle. Thread to be used with the needle may be easily passed through the loop, which is substantially larger than the needle eye, and in use the loop is pulled through the fabric, behind the needle, carrying the thread through the fabric.

One form of such needle is disclosed in U.S. Pat. No. 1,293,660. The loops disclosed in this patent are secured to the needles by passing them through a conventional eye formed on the rear of the needle body.

Another form of looped needle, disclosed in U.S. Pat. No. 4,182,341, is intended primarily for surgical purposes. The needle body is formed with a truncated end having a central, dead-ended cavity opening at the end. The free ends of the filament forming the loop are secured within this cavity and the loop projects from the rear of the cavity. This arrangement necessitates that the needle body have a thickness many times the diameter of the filament and can only be employed with very thick needles or with filaments that are so thin as to be practically invisible.

The deficiencies of these previous designs for needles with following loops have apparently prevented such needles from making any substantial market penetration against conventional needles, despite the obvious advantages of the looped needle.

SUMMARY OF THE INVENTION

The present invention is accordingly directed toward a looped needle of a unique design which preserves the advantages of looped needles while overcoming the deficiencies of the prior art.

A preferred embodiment of the present invention utilizes a loop formed of a filament of thin spring steel wire, a plastic, or a similar material which is readily deformable under slight pressures but is highly resilient so as to immediately return to its normal configuration when the deforming forces are terminated and which will not assume any permanent deformation under the range of forces normally encountered in use. The filament is formed into a loop having a normal position, without the imposition of any external forces, lying in a single plane. The loop preferably has a generally diamond shape with two acute angles at opposed ends and two obtuse angles intermediate these ends. The sides of the loop adjacent the needle are preferably shorter than the loop sides remote from the needle so that the adjacent sides are more resistant to closure than the remote sides and so that the angle at the free, remote end of the loop is more acute than the angle at the adjacent end to facilitate the ability of the free end to grasp the thread. The loop is secured to the trailing end of the needle body at one of the acute angles so that the loop lies in a plane including the axis of the needle and, in the absence of any deforming forces, the free acute angle of the loop projects away from the needle body. The sides of the loop adjacent the needle are preferably shorter than the loop sides remote from the needle so that the adjacent sides are more resistant to closure than the remote sides and so that the angle at the free remote end is more acute than the angle at the adjacent end to facilitate the ability of the free end to grasp the thread.

In one embodiment of the invention, the trailing end of the needle body is preferably formed with a pair of concave depressions extending axially on diametrically opposed sides of the body. These depressions may be connected by a slit forming an eye in the manner of most conventional loopless needles or alternatively, the trailing end of the needle may be formed without an eye with just a pair of depressions on diametrically opposed sides. In attaching the filament to the needle the free ends of the filament lengths are laid in the two depressions and are secured to the needle body, preferably by crimping or swaging the sides over the filament ends so that the loop projects behind the needle.

In another embodiment of the invention, the needle body and loop are formed from a single piece of material. This may be accomplished, for example, by fabricating the needle body and loop, such as by injection or compression molding, from a plastic having the desired properties of hardness and resilience. This one-piece may then be coated or "flashed" with chrome or other metallic coating, if desired.

In yet another embodiment of the invention, an open loop of spring steel wire, shaped generally in the form of a diamond as described above, is provided for attachment to conventional sewing needles. In its normal unstressed configuration, the open ends of the filament abut each other, forming one of the acute angles of the diamond. This attachment is secured to an existing conventional sewing needle by inserting the free ends of the filament into the needle eye and securing the abutting ends to each other and, preferably, to a portion of the inner surface of the needle eye by spot welding or with a dry adhesive.

In all of the embodiments, the loop of the needle presents a wide target for attachment of the thread because of its normal diamond shaped configuration. The acute angle at the following end of the loop engages the thread to prevent the thread from slipping, allowing single thread sewing. Because of the rigid position of the loop relative to the needle body, no difficulty is encountered in positioning the eye for threading.

The loop material may be distinctively colored, by anodizing or the like, to increase the visibility of the loop and different size needles may be provided with loops of different colors to assist in distinguishing one size from another. Further, the loop may be formed of a material which glows in response to receipt of light energy as to assist the user in clearly visually distinguishing the outline of the loop.

BRIEF DESCRIPTION OF THE DRAWINGS

Other objectives, advantages and applications of the present invention will be made apparent by the following detailed description of preferred and alternative embodiments of the invention. The description makes reference to the accompanying drawings in which.

DETAILED DESCRIPTION OF THE INVENTION

Figure 1:
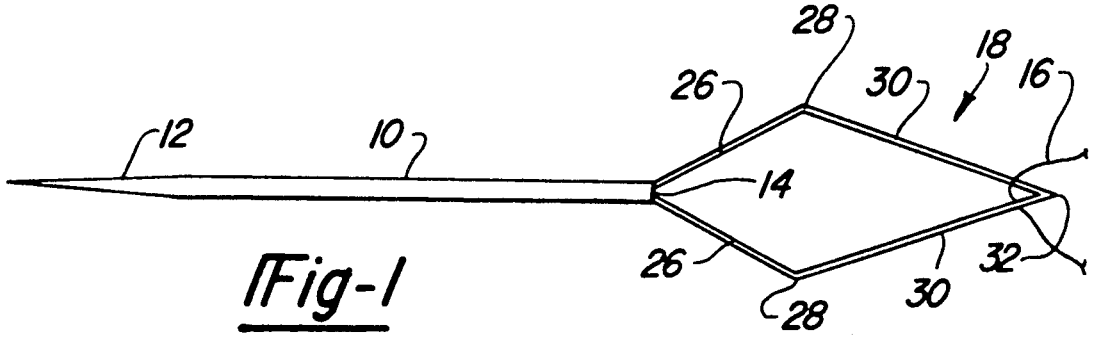
FIG. 1 is a plan view of a first embodiment of a looped needle formed in accordance with the present invention.
Figure 2:
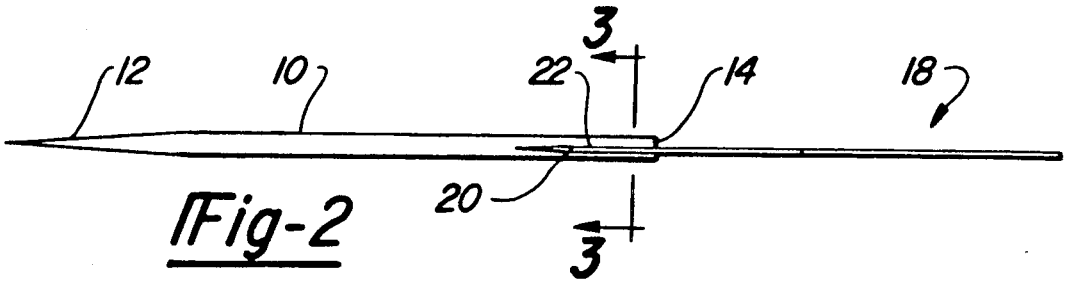
FIG. 2 is a side view of the needle of FIG. 1.
Figure 3:
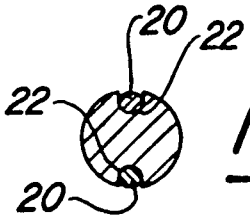
FIG. 3 is a sectional view through the needle of FIG. 1 taken along lines 3—3 of FIG. 2.

In the embodiment of the invention illustrated in FIGS. 1-3, a stainless steel needle body 10, of appropriate diameter and length for hand sewing, has a forward pointed end 12. The rear end of the needle is truncated at 14 and does not incorporate the eye found in conventional needles. A thread 16 to be used with the needle is attached to the needle by passing it through a trailing filament loop, generally indicated at 18.

The loop 18 is formed of a filament which is small in diameter in comparison to the needle body 10, preferably having a diameter no greater than one-third of that of the needle body 10. The filament is preferably metal wire such as spring steel. The wire is resilient and readily deformable.

The wire filament 18 has a pair of free ends 20 which are secured to the trailing end of the needle body 10 by virtue of being crimped, as by a swaging operation, within concave depressions 22 formed axially along the needle body for some distance from its trailing truncated end 14 and opening onto the truncated end. Alternatively, the filament ends could be welded, soldered or otherwise secured within the depressions 22. The concave depressions have a diameter preferably less than about 20% of the diameter of the needle body, so that they do not substantially weaken the needle body.

Loop 18 is formed with a generally diamond shape. The two free ends 20, in their unstressed condition, extend outwardly, away from one another, in the same plane, in sections 26, each of which preferably makes an acute angle with respect to the central axis of the needle. The sections 26 terminate in obtuse angles at bends 28 which define the limits of the widest separation of the loop. This separation between the bends 28 is preferably several times the diameter of the needle body, providing a wide target for easy threading.

The trailing end of the loop 18 is formed by a pair of filament sections 30 which extend from the obtuse angle bends 28 to an acute angle rear bend 32 where they join one another. The sides 30 of the loop preferably form a more acute angle relative to the central axis of the loop than do the sides 26, so that the end of the loop to the rear of the bends 28 is substantially longer than the section of the loop forward of the bends. This configuration assures that the relatively short loop sections 26 will be relatively stiff compared to the relatively long loop sections 30, maintaining the loop, which lies in a single plane with the lengthwise axis of the needle body 10, in an open configuration when unstressed. It also increases the acuity of the rear angle bend 32 so that bend readily grips the thread 16. This grip allows a single needle threading which be may be aided by passing the thread through the loop more than once.

The needle may thus be easily threaded and maintains a positive grip on the sewing thread, and the resilient loop collapses and passes through the fabric being sewn following passage of the needle through the fabric without substantial distortion of the fabric beyond that imposed by the needle and thereafter expands to reassume its unstressed configuration following its passage through the fabric. The loop has sufficient rigidity such that it remains in the single common plane with the needle axis as it collapses upon passage through the fabric and as it expands to its unstressed configuration following such passage.

Figure 4:
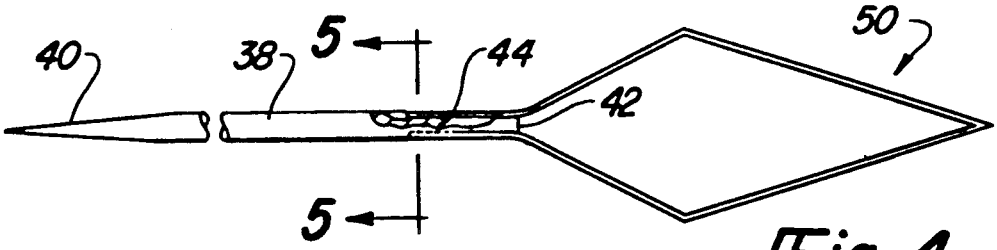
FIG. 4 is a plan view of an alternative embodiment of the invention constructed using a needle having a conventional eye.
Figure 5:
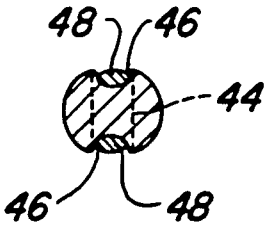
FIG. 5 is a sectional view of the needle of FIG. 4 taken along lines 5—5 of FIG. 4.

In the embodiment illustrated in FIGS. 4 and 5, the needle is conventional and includes a pointed end 40 and a trailing end 42 formed with a conventional eye 44 with a pair of concave depressions 46 defined on opposite sides of the eye. The free ends 48 of a filament loop, generally indicated at 50, are swaged within these depressions. The free ends 48 of the filament loop 50 may also be secured to the conventional needle by applying sufficient heat to the end portion of the needle body 38 near the eye 44 in order to increase its malleability, inserting the free ends 48 of the filament loop into or through the eye 44, and then collapsing the needle body 38 surrounding the eye by using mechanical pressure or otherwise securing the filament ends therebetween. The loop 50 lies in a single plane and preferably has the same diamond-like configuration as the loop 18 used with the embodiment of FIGS. 1-3.

Those skilled in the art will appreciate that attachment techniques such as swaging or crimping or otherwise embedding the free ends 20 of the filament loop into the needle 10 are most effective when performed during the manufacture of the needle, before the needle body 10 has been hardened. It should be noted that any of the above-described embodiments can be utilized to produce a finished product using a relatively malleable needle body. However, when a filament loop 18 is being secured to a conventional sewing needle or a needle body that has already undergone some hardening, the portion of the needle body to which the ends of the filament loop are being attached should be exposed to sufficient heat to increase the malleability of the needle body before any crimping or swaging operation. As an alternative, adhesion means, such as a dry adhesive, welding or soldering may be utilized to affix the filament ends 20 to an already hardened needle body.

Figure 6:
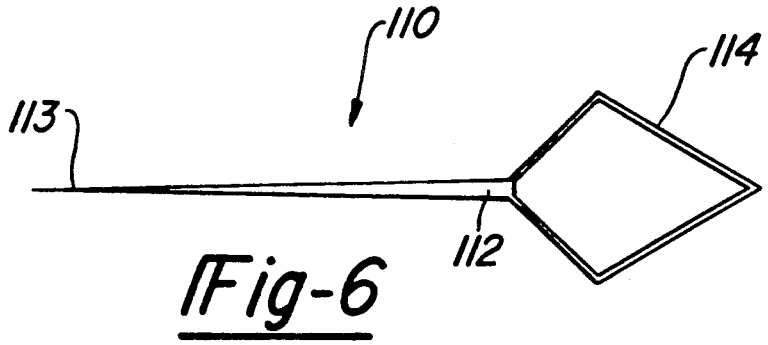
FIG. 6 is a perspective view of a single-piece embodiment of the needle of the present invention formed from injection molded plastic.

The invention embodiment illustrated in FIG. 6 includes an easy-threading needle 110 comprising a thin elongate needle body 112 with a point 113 at one end and a thread-receiving section formed as a closed loop 114 extending from the opposite end. Needle body 112 and loop 114 are formed from a single piece of material, such as plastic or spring steel. When forming the needle body 112 and loop 114 from a single piece of plastic, conventional injection and/or compression molding techniques may be employed. The needle 110 may then be coated, such as by flashing with chrome or other metallic coating, to achieve the desired appearance.

Constructing the needle body and loop as a single unitary member, as shown in FIG. 6, provides an easy threading needle with a securely affixed loop without many of the manufacturing problems and costs associated with similar prior art devices.

Figure 7:
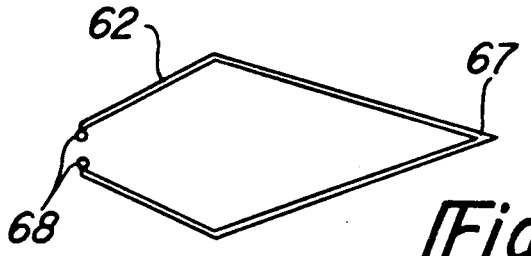
FIG. 7 is a plan view of an attachment clip formed in accordance with the present invention.
Figure 8:
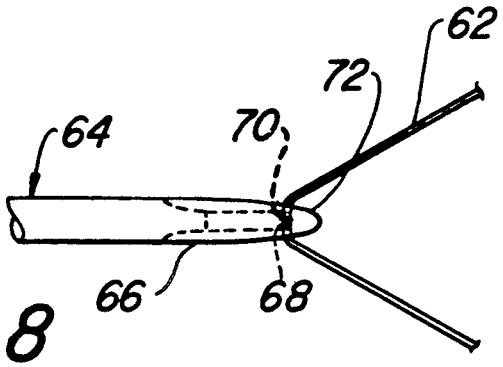
FIG. 8 is a partial view of the clip of FIG. 7 installed on a conventional sewing needle.

In the embodiment of the invention seen in FIGS. 7 and 8, a resilient metallic diamond-shaped open filament loop or clip 62 is provided for a quick attachment to conventional sewing needles. In its normal relaxed condition, the open ends 68 abut each other forming an acute angle at one end of the diamond-shaped loop 62. The clip may be attached to a conventional needle 64 by inserting the abutting ends 68 into the eye 66 of the needle 64 and adhesively or otherwise securing the abutting ends 68 to each other. The clip 62 may then be adhesively secured within the eye 66 of the needle 64, preferably along the inner end face 70 of the eye 66. The clip may also be adhesively secured to the depressions 72 formed on opposite sides of the eye to obtain a more secure attachment to the needle. It should be noted that the clip 62 can be formed as an open loop with the ends nearest the acute angle at the trailing end 67 of the loop 62 initially unattached. After insertion of the loop 62 through the eye of a conventional needle 64, the trailing ends may then be secured to form the acute angle by butt welding or spot welding.

In any of the disclosed embodiments, the loop or, in the unitary embodiment of FIG. 6, the entire needle assembly, may be formed from a material which glows in response to receipt of light energy so as to assist the user in clearly visually distinguishing the outline of the loop to facilitate passage of the thread through the loop. For example, the loop may be formed of a material incorporating a fluorescent dye. Specifically, the loop may be formed of a DAY-GLO TM material of the type disclosed in U.S. Pat. No. 3,915,884.

Although the present invention has been described in connection with its use as a conventional hand sewing needle, the easy threading features of the present invention are equally advantageous in other sewing applications, such as with surgical needles or darning needles. The diamond shape of the filament provides for a quick and substantial flattening of the opposing sides of the loop under relatively low tension to ensure that the hole formed by the needle is not enlarged by the filament.

I claim:

1. A sewing needle assembly comprising:

an elongated rigid needle having a pint at one end and defining a central axis; and a filament formed into a substantially diamond-shaped loop, having a pair of obtuse angles at opposite sides of the loop and acute angles at opposite ends of the loop, and an attachment portion at one end of the loop;

said attachment portion of said filament being fixedly, immovably, and permanently secured to the other end of said needle with said loop positioned in trailing fashion behind said needle with said central axis passing through said acute angles of said loop so as to rigidly maintain said loop in trailing fashion to said needle in a single common plane with the lengthwise axis of said needle;

said loop being resilient and operative to collapse upon contact with the fabric being sewn following passage of said needle through the fabric and being further operative to expand to reassume its unstressed expanded configuration following its passage through the fabric, said loop irrespective of its collapsed or expanded configuration maintaining a disposition wherein said central axis passes through said acute angles so as to facilitate threading of the loop with the loop in its expanded condition and so as to allow the loop to pass through the fabric in its collapsed configuration without substantial distortion of the fabric beyond that imposed by the needle;

said loop being formed of a material which glows in response to receipt of light energy so as to clearly visually define the outline of the loop.

* * * * *